US008763756B1

(12) United States Patent
Kasiński et al.

(10) Patent No.: US 8,763,756 B1
(45) Date of Patent: Jul. 1, 2014

(54) LIGHTWEIGHT WOODEN STAIRS

(71) Applicant: Fakro PP sp. z o.o., Nowy Sacz (PL)

(72) Inventors: Bogusław Kasiński, Nowy Sacz (PL); Bartłomiej Mos, Nowy Sacz (PL)

(73) Assignee: Fakro PP Sp. z o. o., Nowy Sacz (PL)

( * ) Notice: Subject to any disclaimer, the term of this patent is extended or adjusted under 35 U.S.C. 154(b) by 0 days.

(21) Appl. No.: 14/155,177

(22) Filed: Jan. 14, 2014

(30) Foreign Application Priority Data

Jan. 14, 2013 (PL) ..... 402427

(51) Int. Cl.
*E04F 11/06* (2006.01)
*E06C 9/06* (2006.01)

(52) U.S. Cl.
CPC ..... *E04F 11/064* (2013.01); *E06C 9/06* (2013.01)
USPC ..... 182/78; 182/77; 182/81; 52/183; 52/184

(58) Field of Classification Search
CPC ..... E04F 11/062; E04F 11/064; E06C 9/06; E06C 9/085; E06C 9/12
USPC ..... 182/77–80, 95; 52/183, 184
See application file for complete search history.

(56) References Cited

U.S. PATENT DOCUMENTS

| | | | | | |
|---|---|---|---|---|---|
| 2,945,548 | A * | 7/1960 | Tapp | ..... | 182/77 |
| 3,024,863 | A * | 3/1962 | Tapp | ..... | 182/78 |
| 6,866,118 | B1 * | 3/2005 | Battenberg | ..... | 182/77 |
| 2013/0256057 | A1 * | 10/2013 | Kasinski et al. | ..... | 182/81 |

FOREIGN PATENT DOCUMENTS

| | | | | |
|---|---|---|---|---|
| JP | 06288169 | A * | 10/1994 | ..... E06C 9/12 |
| JP | 06322964 | A * | 11/1994 | ..... E04F 19/08 |
| JP | 9-328982 | * | 12/1997 | |
| JP | 10-61358 | * | 3/1998 | |
| JP | 2000-170472 | * | 6/2000 | |

* cited by examiner

*Primary Examiner* — Robert Canfield
(74) *Attorney, Agent, or Firm* — Richards Patent Law P.C.

(57) ABSTRACT

The present disclosure provides a system of light weight folding stairs, especially lightweight wooden stairs, designed for installation in the ceiling of a building. For example, the light weight ladder-type stair system may be opened downwards and unfolded towards inside the room located under this ceiling. At least one ladder-type stair section is connected to a flap that fits within a frame in an opening in the ceiling, wherein the flap hinges open to access the folded stair sections. The ladder-type stair section is connected to the flap by a hook-type holder that allows installing the frame in a ceiling opening without the flap, which can be easily and quickly attached during final stage of assembly.

20 Claims, 6 Drawing Sheets

LIGHTWEIGHT WOODEN STAIRS

CROSS-REFERENCE TO RELATED APPLICATIONS

This application incorporates by reference and claims priority to Polish Patent Application No. P.402427 filed Jan. 14, 2013.

BACKGROUND OF THE INVENTION

The present invention relates to folding stairs, particularly light weight wooden stairs designed for installation in the ceiling of a building or house, wherein the stairs open downward and unfold toward the inside of the room located under the ceiling. The present system may find applications in the building industry, especially for designing entries to lofts and attics.

Folding stairs with hinged mechanisms with variable axis of rotation are known for example the hinge disclosed in Polish patent No. 199927, equipped with a flap which closes the opening in the frame from underside. As the stair sections are fastened to the flap, it also plays a role of a supporting structure for the stairs and, to perform this function, it must be adequately reinforced to withstand loads generated by both own weight of stair sections and the weight of persons using the stairs.

SUMMARY OF THE INVENTION

The present disclosure provides a system of light weight folding stairs, especially lightweight wooden stairs, designed for installation in the ceiling of a building. For example, the light weight ladder-type stair system may be opened downwards and unfolded towards inside the room located under this ceiling. A frame may be installed in an opening in the ceiling, wherein a set of ladder-type stair sections mutually connected by hinges may be unfolded to create a linear ladder. At least one ladder-type stair section is connected to a flap that fits within the opening, and may be hingedly opened from the frame to allow access to the stair sections. The first stair section is connected in a pivoting manner with the frame by means of hinge holders fastened to inner wall of frame, and during unfolding of the stairs the axis of rotation of first stair section retains its position with respect to the frame.

The flap is suspended from the first section of stairs section by at least two pairs of connecting rods which, together with this first section of stairs and the flap itself, form a four-bar linkage. The connecting rods by which the flap is suspended are fixed to it by hook-type holders, each of them being equipped with a bearing seat for a journal fixed in the connecting rod by which the flap is suspended. The mounting access to this seat is closed by the insert having the surface complementing the seat contour and is mounted in snap-locking manner in the body of hook-type holder. The bearing seat of hook-type holder is through-open from both sides, whereas the journal of connecting rod by which the flap is suspended terminates with the flange with diameter greater than the diameter of seat. In such arrangement the lateral movements of the journal in hook-type holder are restricted by abutting the journal flange or the connecting rod against one or the other side wall of hook-type holder.

Further, in the insert which closes the mounting access to the hook-type holder seat, the bearing surface opposite the complementing surface rests, in closed state, on the supporting protrusion in the body of this hook-type holder.

The insert which closes the mounting access to the hook-type holder seat is movably connected with the body of this hook-type holder through the elastic connecting member. This member constitutes a whole with the hook-type holder body and the insert. The latch connected with the insert and locking it in closed position has a catch located on opposite side of the supporting protrusion with respect to the insert. The seat mating with the catch is located in the supporting protrusion on its side opposite with respect to the insert. The latch also has an elastic connecting member which forms a movable connection between the catch and the insert. This elastic connecting member constitutes a whole with the insert and catch of the latch.

The sections of ladder-type stairs are connected using hinges located in joints between subsequent sections, on the top or bottom of stringers of these stair sections. The first section which in unfolded state of stairs is located uppermost and above all other sections is joined with the second section by top-axis hinges having the axis of rotation at the upper surface of stringers of both adjacent stair sections. The next sections of stairs, i.e. the second and the third section, are connected by means of low-axis hinges having the axis of rotation at the lower surface of stringers of both adjacent stairway sections.

The first section of stairs, on its end opposite to the joint with the second segment, is connected with the frame by hinged holders secured to the inner wall of the frame. In the pair of connecting rods located closest to the hinged holders at least one rod is provided in the form of double-arm lever, connected in its central part with the first section of stairs in a rotating manner. The arm of this lever located opposite the flap is connected through the pull rod with the frame, preferably with hinged holder mounted on it. In the folded state, where all sections of stairs are hidden inside the frame, the flap closes the frame and the connecting member in the form of double-arm lever pulls the flap against first section of stairs. During opening of the stairs to the room under the attic, the flap together with stair sections opens downwards and then moves away of the first section of stairs, thereby increasing the clearance for user's feet.

The first section of stairs is suspended from the frame also by means of a pair of spacer connecting members located on both sides of this section, at the outer side of each stringer. The purpose of these spacer connecting members is to limit the stair opening angle. Preferably, each spacer connecting member consists of two flat pull rods connected with each other by means of pivoting joint. Lower ends of these spacer connecting members are connected to transversal supporting beam which protrudes from both sides of first section of stairs beyond the stringers of this section. This supporting beam is positioned in the recesses extracted in lower surfaces of stringers of first stair section, particularly near the half of length of this section. The supporting beam is equipped with lugs which connect it with stringers of first section of stairs.

Further, the stairs are equipped with tension springs that assist raising of stairs during their closing and attenuate dropping of stairs, causing them to fall more gently during opening. Lower ends of these springs are secured to movable components of stairs near the points where the supporting beam connects with spacer connecting members. Preferably, lower ends of these springs are fastened to the ends of supporting beam, near the points where the beam joints with spacer connecting members. Upper ends of tension springs are secured to extension arms protruding upwards from frame corners. Preferably, the tension force of springs is so adjusted that it exceeds the weight of sections of stairs and the flap and, therefore, presses the flap against the frame. Should the springs with smaller tension be used, the flap is equipped with additional lock retaining it in closed position.

The present disclosure provides a folding stair system for installation in a ceiling, wherein the stair system folds down from an opening in a ceiling, the system comprising a flap configured to fit flush within the opening in the ceiling, wherein the opening is defined by a frame, wherein the flap is hingedly connected to the frame. The system also includes at least two ladder-type stair sections hingedly connected together, wherein the ladder-type stair sections convert between a folded position and a ladder position, wherein the folded position the ladder-type sections are foldably stacked upon one another, wherein the ladder position the ladder-type sections unfolded into a linear ladder.

The system includes a hook-type holder connecting a ladder-type stair section to the flap, wherein the hook-type holder includes a body including a base and a hook, wherein the base is in contact with the flap, wherein the base includes a protrusion defining a catch seat space between the base and the flap, wherein the hook extends above the base and curves over the base, wherein the hook includes a top surface and a bottom surface. The hook-type holder also includes a latch extending from the top surface of the hook, wherein the latch includes an insert and a catch.

The system also includes a cylindrical journal inserted into a journal seat space defined by the bottom surface of the hook, wherein the cylindrical journal is connected to a first end of a connecting member, wherein a second end of the connecting member is attached to a first end of a pull rod, wherein a second end of the pull rod is connected to the frame.

The hook is configured to move between an open position and a closed position. In the closed position, the insert is held in contact with a surface of the cylindrical journal when the catch is in the catch seat space and engaged with the protrusion of the base.

In an example, the system also includes at least one cylindrical flange attached to an outer surface of the cylindrical journal, wherein a diameter of the cylindrical flange is greater than a diameter of the cylindrical journal, wherein the cylindrical flange rests flush against an outer surface of the hook.

The insert may be movably connected to the latch by an elastic connecting member. The catch may be connected to the insert by an elastic connecting member.

The system may further include a hinged holder, wherein the hinged holder is connected to an inner wall of the frame, wherein the second end of the pull rod is connected to the hinged holder.

In an example, the system may also include a pair of spacer connecting members pivotally connected to each other, wherein a first end of a first spacer connecting member is connected to the frame, wherein a second end of the pair of spacer connecting members is connected to the flap.

The second end of the pair of spacer connecting members may be connected to a transversal supporting beam attached to the flap, wherein the supporting beam is attached to a first ladder-type stair section. The supporting beam may be positioned in a recess in the first section of stairs.

The system may also include a tension spring connecting the first ladder-type stair section with the frame. The tension spring may be connect the spacer connecting member to the frame.

In another embodiment, the folding stairs are designed for installation in the ceiling of a building, for example, opening downwards together with a flap designed for closing the opening in the building ceiling from the underside and unfolding into the room located under the ceiling. The folding stairs include a plurality of ladder-type stairs sections connected to each other by hinges located in individual joints of consecutive stairs sections at upper and lower ends of stringers of the consecutive stairs sections, wherein the plurality of stairs sections including a first stairs section and a second stairs section.

The first stairs section, which in an unfolded state, takes the highest position amongst all of the stair sections, is pivotally connected with a frame and an axis of rotation between the first stair section and the frame remains unchanged regardless of the position of the folding stairs. The second stairs section is connected to the first stair section by at least one high-axis hinge having an axis of rotation at an upper section of the stringers of both of the first stairs section and the second stairs section.

The flap is suspended from the first stairs section by at least two pairs of connecting members that together with the first stairs section and the flap form a four-bar linkage. The connecting members suspending the flap are connected with the flap by hook-type holders, each hook-type holder including a bearing seat engaging a journal seated in one of the connecting members on which the flap is suspended, wherein the mounting access to the bearing seat is closed by an insert including a surface complementing the bearing seat and fastened to the hook-type holder by a latch.

The bearing seat of each hook-type holder may be open at both sides of the hook-type holder forming a through opening and the journal of the connecting member that suspends the flap ends with a flange having a diameter greater than a diameter of the bearing seat. A bearing surface of the insert that is opposite to the surface complementing the bearing seat may rest, when the hook holder is in a closed state, on a supporting protrusion in a body of the hook-type holder An elastic connecting member may movably connect the insert with the body of the hook-type holder. An elastic connecting member may connect the catch to the insert.

In an example, the latch may include a catch located at the opposite side of the supporting protrusion from the insert and a seat mating with the catch is located in the supporting protrusion.

The first stairs section may be connected to the frame by hinged holders secured to an inner wall of the frame, wherein the pair of connecting members located closest to the hinged holders on which the flap is suspended includes at least one double-arm lever including a first arm pivotally connected in a central area of the first stairs section and a second arm connected to the frame by a pull rod.

In another example, the first stairs section is suspended from the frame by a pair of spacer connecting members, each spacer connecting member including two flat pull rods connected pivotally to each other by a pin.

The spacer connecting members may be connected to a transversal supporting beam located near the half-length of the first stairs section and extending wider at both sides than the stringers of the first stairs section.

A plurality of tension springs may connect the first stairs section with the frame, wherein the tension springs are secured to movable components near where the supporting beam connects with the spacer connecting members.

An advantage of the present system is that because a section of stairs, not a flap, is used as the supporting structure connecting the moving elements with the frame, the flap itself is lighter and more convenient in use as compared with known solutions.

Another advantage of the present system is that the hook-type holders allow installing the frame in a ceiling opening without the flap, which can be easily and quickly attached during final stage of assembly.

Yet another advantage of the present system is the positioning of a supporting beam in recesses extracted in the first section of stairs in order to reduce the overall dimensions of folded stairs, thereby facilitating transportation.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar element.

DETAILED DESCRIPTION OF THE INVENTION

Figure 1:
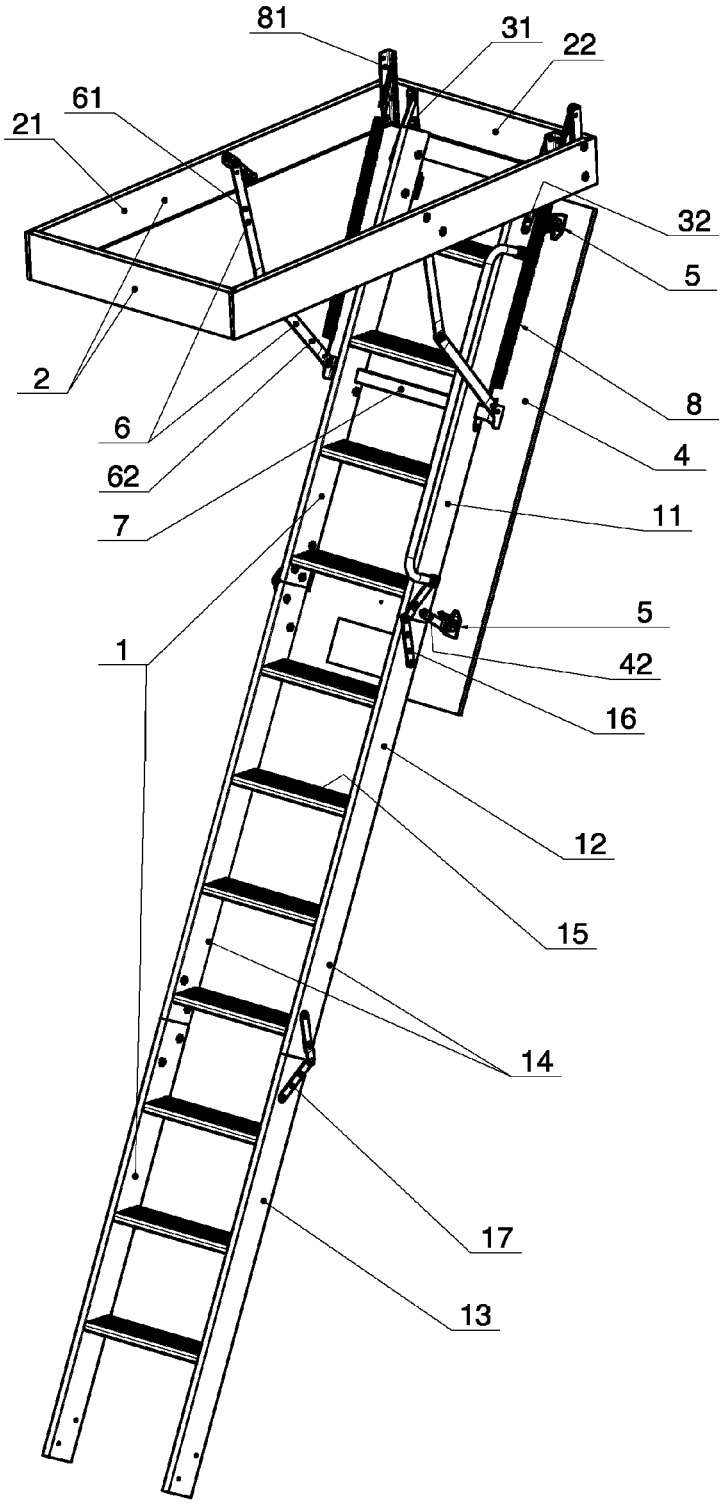
FIG. 1 is a perspective view of an embodiment of the ladder-type stairs in an unfolded state and ready for use.
Figure 2:
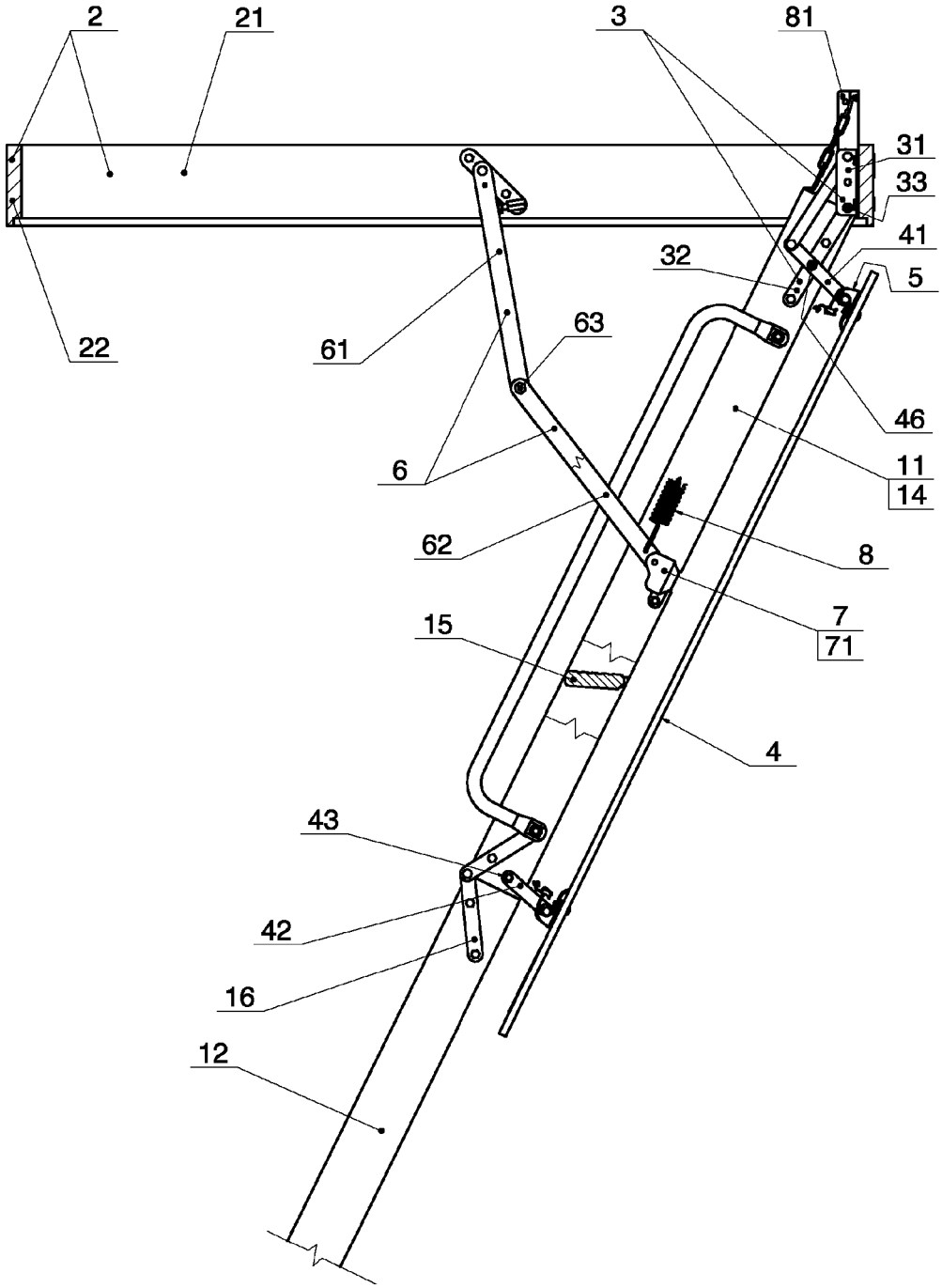
FIG. 2 is a side view of the first and second segment of ladder-type stairs in an unfolded state along with cross-sectional view of suspended flap.
Figure 3:
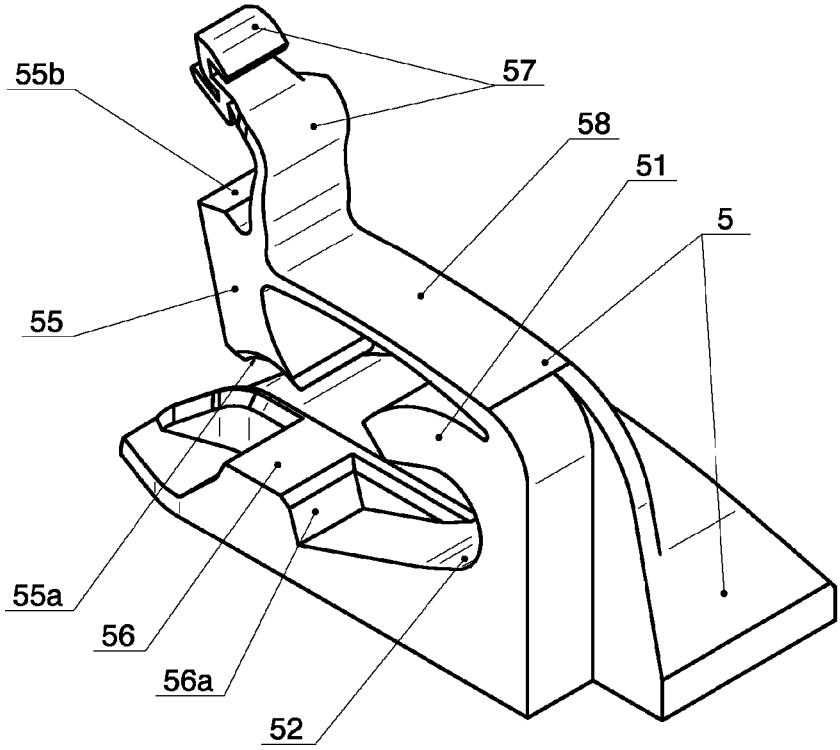
FIG. 3 is a perspective view of the hook-type holder in open state, as seen from the side of the insert and supporting protrusion.
Figure 4:
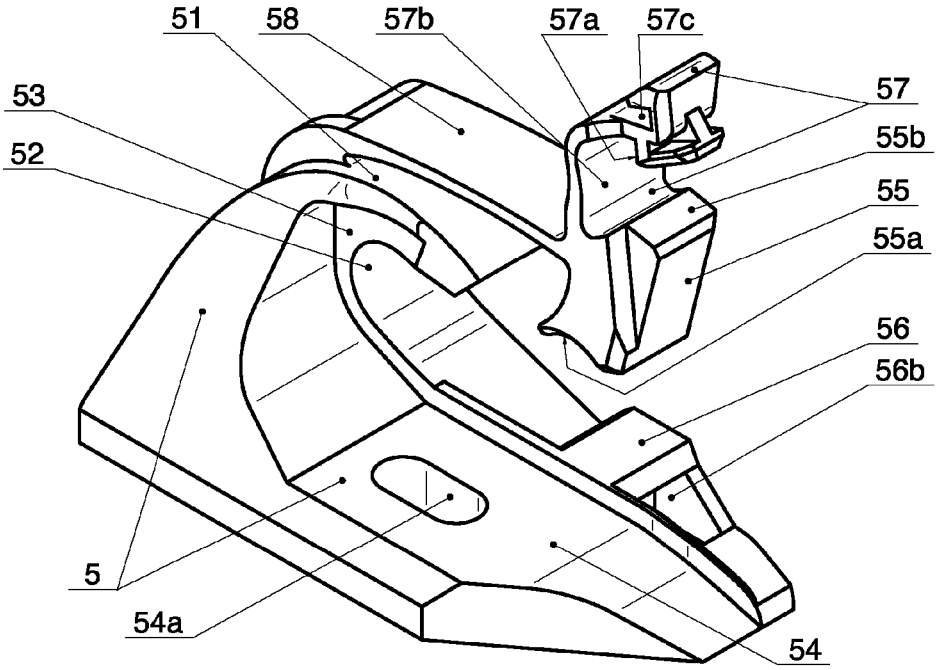
FIG. 4 is a perspective view of the hook-type holder in open state, as seen from the side of foot securing it to the flap.
Figure 5:
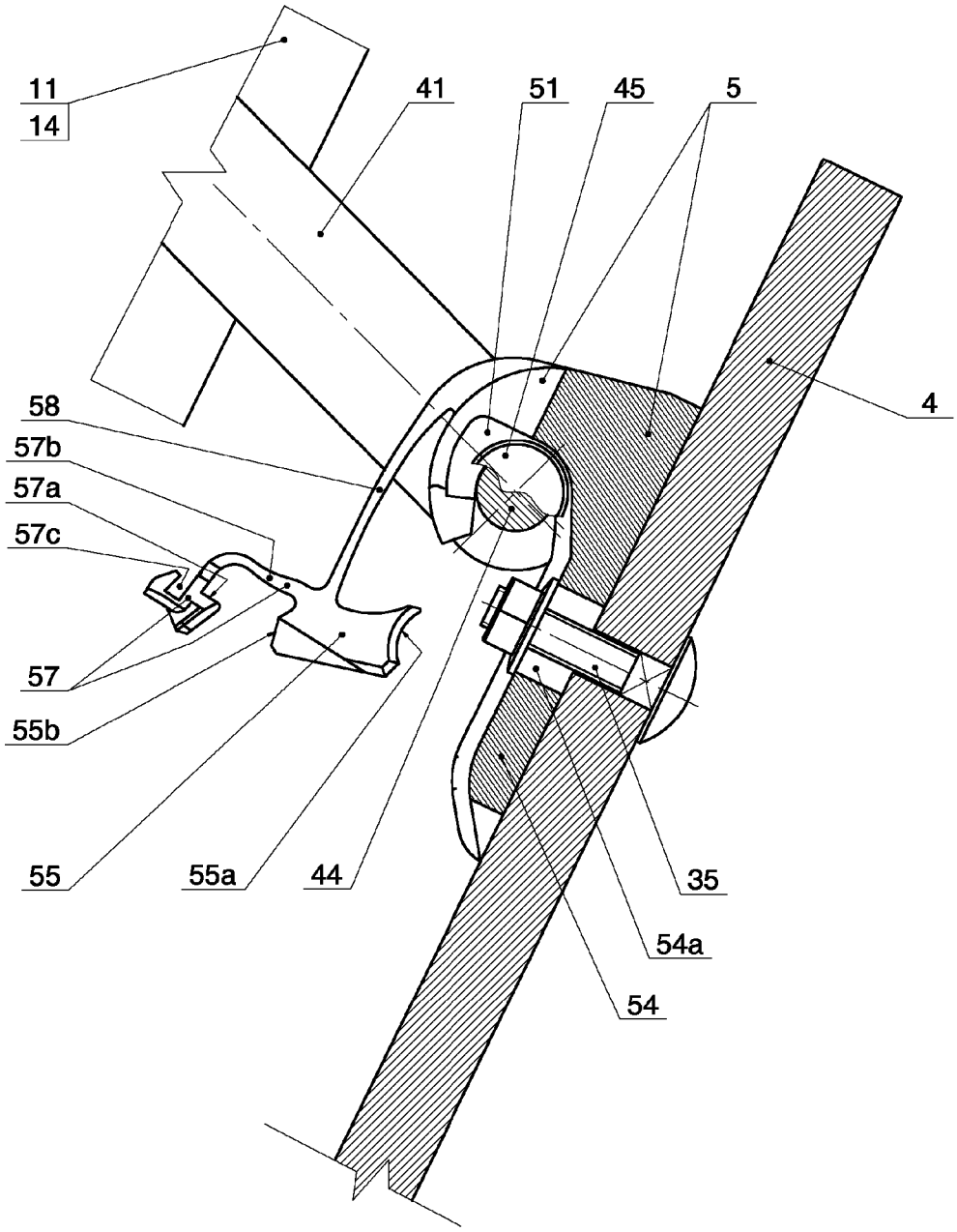
FIG. 5 is a vertical cross-section view of an example of the connection between the flap and hook-type holder in open state, where in the cross-section is taken through the bolt connecting these elements.
Figure 6:
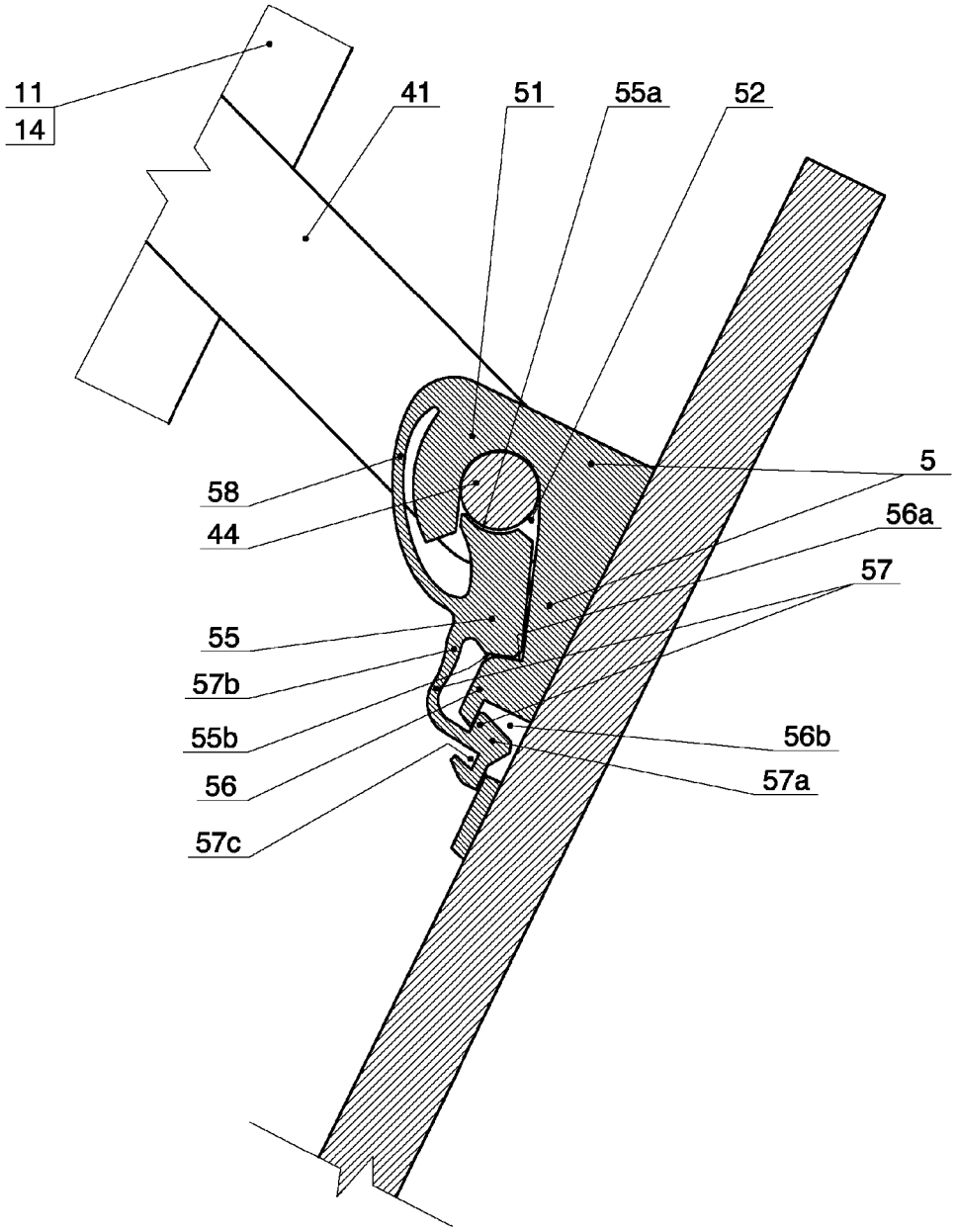
FIG. 6 is a perspective view of a connection between the flap and hook-type holder in closed state in vertical cross-section through the seat, insert and latch.
Figure 7:
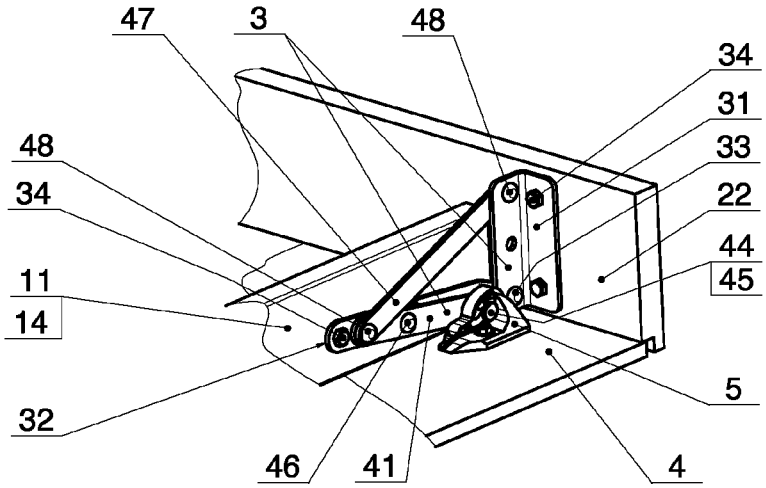
FIG. 7 is a perspective view of the first stair section connection with the frame.
Figure 8:
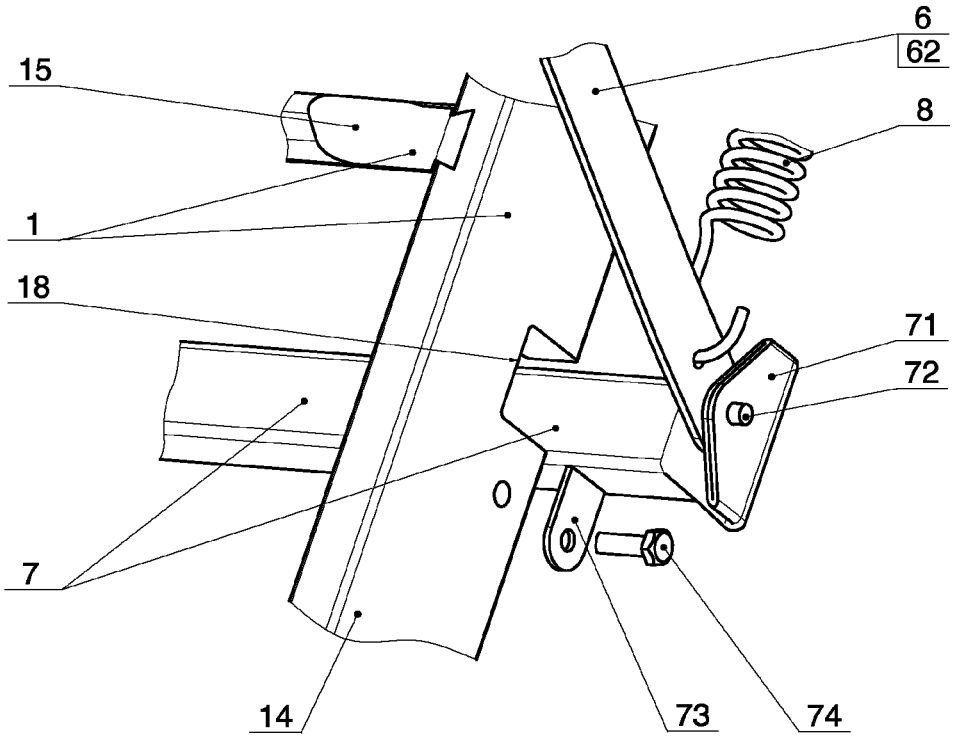
FIG. 8 is a perspective view of the connection between supporting beam and first section of stairs, together with the pull rod.

The main assembly of folding stairs is a set of ladder-type sections 1 consisting of the first section 11, the second section 12 and the third section 13. Each of those sections contains two stringers 14, the left one and the right one, with steps 15 fitted between them, and the individual sections are connected with each other by means of hinges secured to the end portions of stringers 14.

The first section 11 and the second section 12 of stairs are joined with each other by means of high-axis hinges 16 with the axis of rotation located at upper surface of stringers 14, whereas the second section 12 and the third section 13 are joined with each other by means of low-axis hinges with the axis of rotation located at lower surface of stringers 14.

The stairs have the frame 2 consisting of two longitudinal walls 21 and two transverse walls 22. The frame is seated in the ceiling above the room to which the stairs are to be unfolded for use. First section 11 of stairs in unfolded state is located in the upmost position, second segment 12 is a middle one and third segment 13 is located in the lowest position and rests against the floor of the room under the ceiling. In the stairs in folded state the segments 12 and 13 rest on the first segment 11, and the whole set of segments is hidden inside the frame 2.

The first segment 11 is connected by its stringers 14 with transverse wall 22 of the frame by means of two hinged holders 3, each of them consisting of angle bar 31 and stringer-adjacent strip 32 connected by means of the pin 33 located at lower end of angle bar 31. Both hinged holders 3 are so positioned that the pins 33 belonging to them are concentric, thus forming common axis of rotation of the first section 11 and other two sections with respect to the frame 2, while the axis of rotation of those sections does not change during folding or unfolding of stairs. The angle bar 31 and stringer-adjacent strip 32 are secured by means of bolts 34 to transverse wall 22 of the frame and to stringers 14 of the first section 11, respectively.

Stairs are also equipped with flap 4 which closes the opening in frame 2 from underside when the set of ladder-type sections of stairs 1 is in folded state. The flap 4 is suspended from the first segment 11 of stairs by two pairs of connecting rods and connecting rods of each pair are located at both sides of the first stairs section 11, outwards of stringers 14 of this section. Next to the hinged holders 3 the double-arm connecting members 41 are located and near opposite end of the first stairs section 11 the straight connecting members 42 are installed. The upper end of straight connecting member 42 is joined in articulating manner by the bolt 43 with the first stairs section 11.

Low ends of double-arm connecting member 41 and straight connecting member 42 are secured by means of hook-type holders 5 to the flap 4. The hook-type holder 5 has the body whose base contacts with the flap 4, and above this base the hook 51 is provided with seat 52 extending through it and having the surface in the form of cylindrical sector. In the seat 52 the cylindrical journal 44 of the double-arm connecting member 41 or the straight connecting member 42 is located which abuts on the side surface of hook 51. The journal 44 is attached to the connecting member 41 or 42 in non-detachable manner and its free end has the cylindrical flange 45 mating with under-flange surface 53 of hook holder 5. The hook holder 5, on the side which after mounting the holder on flap 4 becomes the side outer with respect to the stairs 11, has the fixing foot 54 with oval bore **54*a* for the bolt 35 with nut attaching the holder to the flap 4**.

The mounting access to the seat 52 is closed by the insert 55 with a part of the surface shaped in the form of cylindrical sector complements the bearing **55*a*. The opposite bearing surface 55*b* of the insert 55 rests in closed state on supporting protrusion 56 in the hook holder body 5, and more precisely, on the supporting surface 56*a*** of this protrusion.

Also, the hook holder 5 has the latch 57 which keeps the insert 55 in fixed position when the hook holder is closed. In the latch the catch **57*a* is provided, connected with the insert 55 by means of an elastic connecting member 57*b* constituting a whole with the insert 55 and the catch 57*a* of the latch. The catch 57*a* of the latch 57, positioned on the side of supporting protrusion 56 which is opposite with respect to the insert 55, in closed state engages into the seat 56*b* in this supporting protrusion. The latch 57 also has the releasing groove 57*c* for the tool, e.g. a screwdriver, used for removing the catch 57*a* from the seat 57*b***.

The insert 55 is connected, by means of movable connection, with the body of hook-type holder 5 through the elastic connecting member 58 which constitutes a whole with hook holder 5 and the insert 55. The hook holders secured to the flap 4 are so positioned that their hooks 51 are directed outwards. In such arrangement the hooks 51 transmit the highest component forces present in connecting members 41 and 42 and caused by the flap weight. Due to asymmetric position of the fastening foot 54 with respect to the hook 51 and the seat 52, the set of four hook holders 5 consists of two left-side holders and two right-side holders, secured to the flap 4 crosswise, i.e. along the diagonal.

In the mechanism designed for suspending the first stairs section 11 and the flap 4 the double-arm connecting member 41, in its central area, is connected with stringer-adjacent strip 32 of hinged holder 3 by means of central pin 46, and the upper end of double-arm connecting member 41 is connected with the upper part of angle bar 31 of hinged holder 3 by means of pull rod 47. Both ends of pull rod 47 are connected, by means of pins 48 forming the articulated joints, with parts mating with this pull rod.

The first section 11 of stairs, the double-arm connecting member 41 on its part between central pin 46 and the hook holder 5, the straight connecting member 42 and the flap 4 form a four-bar linkage mechanism, whose motion is caused by action of the pull rod 47 and upper part of double-arm connector 41 which, together with the angle bar 31 and stringer-adjacent strip 32, form a four-bar linkage mechanism also. When placing the set of ladder stairs inside the frame 2, in the final phase of closing this set of stairs and placing it in rest position, both four-bar linkages move the flap 4 into position adjacent to the frame 2. Since the distance between flap 4 and first stairs section 11 is minimal, the whole structure is compact, facilitating transportation and storage of the stairs. With stairs in open position, including open for use, both four-bar linkages move the flap 4 to the position distant from the first segment 11 by the distance enough to ensure proper space for feet of person stepping on the steps 15 of this stairs section.

Apart from being connected with the door frame 2 by means of hinged holders 3, the first stairs section 11 is also suspended from the frame by means of spacer connecting members 6 located at both sides of this section, on the outer sides of its stringers 14. The spacer connecting member 6 consists of two flat pull rods, i.e. the upper pull rod 61 and lower pull rod 62, joined together by means of joint 63. The ends of both lower pull rods 62 are connected to the transverse supporting beam 7 which extends beyond the stringers 14 of this first stairs section 11 at both sides of this section. At the ends of the supporting beam the bends are provided which form the supporting lugs 71 which, by means of pins 72, are connected with lower pull rods 62 of both spacer connecting members. Upper end of spacer connecting member 6 is secured to the frame by means of side holder which is bolted to the longitudinal wall 21 of the frame 2.

The supporting beam 7 is located near the half-length of the first stairs section 11 and enters the recesses 18 formed in lower surfaces of stringers 14 of this section. By placing the beam in recess it is possible to minimize the distance between the flap 4 and the first stairs section 11 when the stairs are folded in closed position. The supporting beam has lugs 73, along with bolts 74, fastens the beam to stringers 14 of the first stairs section 11 at its right and left side. The folding stairs are also equipped with two tension springs 7 which assist rising of stairs during their closing and attenuate dropping of stairs during their opening. Lower ends of these springs are secured to lower pull rods 62 of spacer connecting member 6 near the point at which this pull rod connects with the supporting beam 7. Upper ends of tension springs 8 are fitted by means of coil chain section to outriggers 81 which are mounted in corners of the frame 2, protrude upwards and are secured to it by means of bolts.

In an embodiment, the present disclosure includes folding stairs, especially lightweight wooden stairs, designed for installation in the ceiling of a building, opening downwards together with a flap designed for closing the opening in building ceiling from underside and unfolding into the room located under this ceiling, the folding stairs consisting of ladder-type stairs sections connected to each other by means of hinges located in individual joints of consecutive stairs segments at upper or lower ends of stringers of these stairs sections; wherein a first section which in unfolded state of stairs takes the highest position among all other sections is pivotally connected with the frame and its axis of rotation remains unchanged with respect to the frame, and the first section and the second section are connected with each other by means of high-axis hinges having their axis of rotation at an upper surface of the stringers of both these sections of stairs, characterized in that the flap (4) is suspended from the first section of stairs (11) by means of at least two pairs of connecting members (41, 42) which, together with the first section of stairs and the flap form the four-bar linkage, and the connecting members (2) on which the flap is suspended are connected with the flap by means of hook-type holders (5), each of them having a bearing seat (52) for engaging the journal (44) seated in connecting member on which the flap is suspended, and the mounting access to this seat (51) is closed by the insert (55) having the surface (55*a*) complementing the seat and fastened to the hook-type holder (5) body by means of the latch.

The folding stairs may be characterized in that the bearing seat (52) of the hook-type holder (5) is open at both holder's sides forming a through opening, and the journal (44) of the connecting member (41, 41) which suspends the flap end with the flange (45) having the diameter greater than the diameter of seat (51).

The folding stairs may be characterized in that the bearing surface (55*b*) of the insert (5) opposite with respect to the surface complementing the bearing (55*a*) rests, when the hook holder (5) is in closed state, on the supporting protrusion (56) in the body of hook-type holder.

The folding stairs may be characterized in that the insert (55) is movably connected with the body of hook-type holder (5) by means of the elastic connecting member (58) constituting a whole with the body of hook-type holder (5) and the insert (55).

The folding stairs may be characterized in that the catch (57*a*) of the latch (57) connected with the insert is located at the opposite side of the supporting protrusion (56) with respect to the insert (55), and the seat (56*b*) mating with the catch (57*a*) of the latch is located in supporting protrusion (56).

The folding stairs may be characterized in that the catch (57*a*) of the latch (57) is connected with the insert (55) by means of an elastic connecting member (57*b*) constituting a whole with the insert (55) and the catch (57*a*) of the latch. Stairs according to claim 1, or claim 2, or claim 3, or claim 4, or claim 5, or claim 6, characterized in that the first section (11) of stairs is connected with the frame (2) by means of hinged holders (3) secured to inner wall of the frame and in the pair of connecting members (41) on which the flap is suspended and located closest to the hinged holders, at least one member is made in the form of double-arm lever connected pivotally in its central area with the first section (11) of stairs and the arm of this double-arm lever which is opposite with respect to the flap is connected by means of the pull rod (47), with the frame (2), preferably with the hinged holder (3) fastened to this frame.

The folding stairs may be characterized in that the first section (11) of stairs is connected with the frame (2) by means of hinged holders (3) secured to inner wall of the frame and in the pair of connecting members (41) on which the flap is suspended and located closest to the hinged holders, at least one member is made in the form of double-arm lever connected pivotally in its central area with the first section (11) of stairs and the arm of this double-arm lever which is opposite with respect to the flap is connected by means of the pull rod (47), with the frame (2), preferably with the hinged holder (3) fastened to this frame.

The folding stairs may be characterized in that the first section (11) of stairs is suspended from the frame (2) also by means of a pair of spacer connecting members (6), and each of these members preferably consists of two flat pull rods (51, 52) connected pivotally to each other by means of a pin (53).

The folding stairs may be characterized in that the spacer connecting members (6) are connected to transversal supporting beam (7), particularly situated near the half-length of the first section (11) of stairs and extending beyond the stringers (14) of this stairs section at both sides.

The folding stairs may be characterized in that they have tension springs (8) connecting the first section (11) of stairs with the frame (2), said springs assisting raising of stairs during their closing and attenuating dropping of stairs during their opening, and lower ends (5) of those springs are secured to movable components of stairs near the points where the supporting beam (7) connects with spacer connecting members (6).

The invention claimed is:

1. A folding stair system for installation in a ceiling, wherein the stair system folds down from an opening in a ceiling, the system comprising:

a flap configured to fit flush within a frame of the opening in the ceiling, wherein the flap is hingedly connected to the frame;

at least two ladder-type stair sections hingedly connected together, wherein the ladder-type stair sections convert between a folded position and a ladder position, wherein the folded position the ladder-type sections are foldably stacked upon one another, wherein the ladder position the ladder-type sections unfolded into a linear ladder;

a hook-type holder connecting a ladder-type stair section to the flap, wherein the hook-type holder includes:

a body including a base and a hook, wherein the base is in contact with the flap, wherein the base includes a protrusion defining a catch seat space between the base and the flap, wherein the hook extends above the base and curves over the base, wherein the hook includes a top surface and a bottom surface, a latch extending from the top surface of the hook, wherein the latch includes an insert and a catch; and a cylindrical journal inserted into a journal seat space defined by the bottom surface of the hook, wherein the cylindrical journal is connected to a first end of a connecting member, wherein a second end of the connecting member is attached to a first end of a pull rod, wherein a second end of the pull rod is connected to the frame, wherein the hook is configured to move between an open position and a closed position, wherein, in the closed position, the insert is held in contact with a surface of the cylindrical journal when the catch is in the catch seat space and engaged with the protrusion of the base.

2. The system of claim 1 further comprising at least one cylindrical flange attached to an outer surface of the cylindrical journal, wherein a diameter of the cylindrical flange is greater than a diameter of the cylindrical journal, wherein the cylindrical flange rests flush against an outer surface of the hook.

3. The system of claim 1 wherein the insert is movably connected to the latch by an elastic connecting member.

4. The system of claim 1 wherein the catch is connected to the insert by an elastic connecting member.

5. The system of claim 1 further comprising a hinged holder, wherein the hinged holder is connected to an inner wall of the frame, wherein the second end of the pull rod is connected to the hinged holder.

6. The system of claim 1 further comprising a pair of spacer connecting members pivotally connected to each other, wherein a first end of a first spacer connecting member is connected to the frame, wherein a second end of the pair of spacer connecting members is connected to the flap.

7. The system of claim 6 wherein the second end of the pair of spacer connecting members is connected to a transversal supporting beam attached to the flap, wherein the supporting beam is attached to a first ladder-type stair section.

8. The system of claim 7 wherein the supporting beam in positioned in a recess in the first section of stairs.

9. The system of claim 7 further comprising a tension spring connecting the first ladder-type stair section with the frame.

10. The system of claim 9 wherein the tension spring connects the spacer connecting member to the frame.

11. Folding stairs designed for installation in the ceiling of a building, opening downwards together with a flap designed for closing the opening in the building ceiling from the underside and unfolding into the room located under the ceiling, the folding stairs comprising:

a plurality of ladder-type stairs sections connected to each other by hinges located in individual joints of consecutive stairs sections at upper and lower ends of stringers of the consecutive stairs sections, the plurality of stairs sections including a first stairs section and a second stairs section;

wherein the first stairs section, which in an unfolded state, takes the highest position amongst all of the stair sections, is pivotally connected with a frame and an axis of rotation between the first stair section and the frame remains unchanged regardless of the position of the folding stairs;

wherein the second stairs section is connected to the first stair section by at least one high-axis hinge having an axis of rotation at an upper section of the stringers of both of the first stairs section and the second stairs section;

wherein the flap is suspended from the first stairs section by at least two pairs of connecting members that together with the first stairs section and the flap form a four-bar linkage; and the connecting members suspending the flap are connected with the flap by hook-type holders, each hook-type holder including a bearing seat engaging a journal seated in one of the connecting members on which the flap is suspended, wherein the mounting access to the bearing seat is closed by an insert including a surface complementing the bearing seat and fastened to the hook-type holder by a latch.

12. The folding stairs of claim 11 wherein the bearing seat of each hook-type holder is open at both sides of the hook-type holder forming a through opening and the journal of the connecting member that suspends the flap ends with a flange having a diameter greater than a diameter of the bearing seat.

13. The folding stairs of claim 12 wherein a bearing surface of the insert that is opposite to the surface complementing the bearing seat rests, when the hook holder is in a closed state, on a supporting protrusion in a body of the hook-type holder.

14. The folding stairs of claim 13 wherein an elastic connecting member movably connects the insert with the body of the hook-type holder.

15. The folding stairs of claim 14 wherein the latch includes a catch located at the opposite side of the supporting protrusion from the insert and a seat mating with the catch is located in the supporting protrusion.

16. The folding stairs of claim 15 wherein an elastic connecting member connects the catch to the insert.

17. The folding stairs of claim 11 wherein the first stairs section is connected to the frame by hinged holders secured to an inner wall of the frame, wherein the pair of connecting members located closest to the hinged holders on which the flap is suspended includes at least one double-arm lever including a first arm pivotally connected in a central area of the first stairs section and a second arm connected to the frame by a pull rod.

18. The folding stairs of claim 17 wherein the first stairs section is suspended from the frame by a pair of spacer connecting members, each spacer connecting member including two flat pull rods connected pivotally to each other by a pin.

19. The folding stairs of claim 18 wherein the spacer connecting members are connected to a transversal supporting beam located near the half-length of the first stairs section and extending wider at both sides than the stringers of the first stairs section.

20. The folding stairs of claim 19 wherein a plurality of tension springs connect the first stairs section with the frame, wherein the tension springs are secured to movable components near where the supporting beam connects with the spacer connecting members.

* * * * *